US008257162B2

(12) United States Patent
Saito

(10) Patent No.: US 8,257,162 B2
(45) Date of Patent: Sep. 4, 2012

(54) SLOT MACHINE

(75) Inventor: Hiroki Saito, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 704 days.

(21) Appl. No.: 12/402,106

(22) Filed: Mar. 11, 2009

(65) Prior Publication Data

US 2009/0233689 A1 Sep. 17, 2009

Related U.S. Application Data

(60) Provisional application No. 61/035,595, filed on Mar. 11, 2008.

(51) Int. Cl.
*A63F 9/24* (2006.01)

(52) U.S. Cl. ..... 463/20

(58) Field of Classification Search ..... 463/16, 463/22, 20; 273/138.1, 138.2, 139
See application file for complete search history.

(56) References Cited

U.S. PATENT DOCUMENTS

| | | | | |
|---|---|---|---|---|
| 6,935,947 | B1 * | 8/2005 | Singer et al. | 463/16 |
| 7,674,168 | B2 * | 3/2010 | Gerrard et al. | 463/16 |
| 7,862,420 | B2 * | 1/2011 | Peterson et al. | 463/20 |
| 2003/0216165 | A1 * | 11/2003 | Singer et al. | 463/20 |
| 2004/0053672 | A1 * | 3/2004 | Baerlocher | 463/20 |
| 2004/0072606 | A1 * | 4/2004 | Majima et al. | 463/16 |
| 2004/0195773 | A1 * | 10/2004 | Masci et al. | 273/317 |
| 2004/0219969 | A1 * | 11/2004 | Casey et al. | 463/20 |
| 2005/0003880 | A1 | 1/2005 | Englman et al. | |
| 2005/0043082 | A1 * | 2/2005 | Peterson et al. | 463/20 |
| 2005/0075163 | A1 | 4/2005 | Cuddy et al. | |
| 2009/0054129 | A1 * | 2/2009 | Yoshimura et al. | 463/20 |
| 2011/0117989 | A1 * | 5/2011 | Kennedy et al. | 463/20 |

FOREIGN PATENT DOCUMENTS

WO 2007130444 A2 11/2007

OTHER PUBLICATIONS

Office Action issued on Aug. 23, 2010 in the corresponding to the Macao Patent Application No. I/929.

* cited by examiner

*Primary Examiner* — Jarrett Stark
*Assistant Examiner* — Michele Fan
(74) *Attorney, Agent, or Firm* — Lexyoume IP Meister, PLLC.

(57) ABSTRACT

When a game mode is shifted from a base game to a free game, if a symbol of "APPLE" is rearranged in a symbol display frame 111 for the first time in one unit game which composes the free game, the payout amount which is awarded to a player is computed based on the number of the symbols of "APPLE" that are rearranged for the first time. The symbols of "APPLE" that are rearranged for the first time are displayed in the stock area 201. In a following unit game, if the symbol of "APPLE" is rearranged in a symbol display frame 111 again, the payout amount which is awarded to a player is computed based on a total number of the symbols of "APPLE" which is obtained by adding the number of the symbols of "APPLE" being displayed in the stock area 201 to the number of the rearranged symbols of "APPLE". At this time, the rearranged symbols of "APPLE" are additionally displayed in the stock area 201 in addition to the symbols of "APPLE" being displayed in the stock area 201. The same operation will be carried out in the following unit games.

5 Claims, 13 Drawing Sheets

FIG. 3

| CODE NUMBER | EACH VIDEO REEL |
|---|---|
| 21 | FRANKENSTEIN |
| 20 | BELL |
| 19 | APPLE |
| 18 | BELL |
| 17 | CHERRY |
| 16 | ORANGE |
| 15 | PLUM |
| 14 | CHERRY |
| 13 | BELL |
| 12 | APPLE |
| 11 | BELL |
| 10 | ORANGE |
| 09 | PLUM |
| 08 | BLUE 7 |
| 07 | BELL |
| 06 | APPLE |
| 05 | BELL |
| 04 | PLUM |
| 03 | PLUM |
| 02 | CHERRY |
| 01 | BELL |
| 00 | APPLE |

FIG. 6

| SCATTERS | | | | | | | |
|---|---|---|---|---|---|---|---|
| ANY15 | 500 FREE GAMES | 250 | 250 | 50 | 50 | 20 | 20 |
| ANY14 | 300 FREE GAMES | 200 | 40 | 20 | 20 | 15 | 15 |
| ANY13 | 200 FREE GAMES | 100 | 20 | 15 | 15 | 10 | 10 |
| ANY12 | 100 FREE GAMES | 40 | 10 | 10 | 4 | 4 | 4 |
| ANY11 | 40 | 10 | 4 | 4 | 2 | 2 | 2 |
| ANY10 | 10 | 4 | 4 | 2 | 1 | 1 | 1 |
| ANY9 | 4 | 2 | 1 | 1 | — | — | — |

SLOT MACHINE

CROSS-REFERENCE TO RELATED APPLICATIONS

This application is based upon and claims a priority from the U.S. Provisional Patent Application No. 61/035,595 filed on Mar. 11, 2008, the entire contents of which are incorporated herein by reference.

BACKGROUND

1. Field of the Invention

The present invention relates to a slot machine which stocks symbols.

2. Description of Related Art

As is disclosed in US Patent Application Publication No. 2005/0003880A1, for example, there has been a gaming machine in which a progressive game proceeds according to a selection result of a player.

The gaming machine stocks "stars" displayed on a display device according to a selection result of a player during a jackpot game. When a predetermined number of "stars" are stocked, the gaming machine shifts a game mode from a jackpot game to a super jackpot game.

Therefore, if an increasing rate of the stocked "stars" ticks up until the gaming machine shifts a game mode from a jackpot game to a super jackpot game, a player is getting excited.

In this respect, in a conventional slot machine, the amount of prize paid to a player who wins a jackpot is displayed on a display device. Therefore, also in the conventional slot machine, if an increasing rate of the amount of prize of a jackpot ticks up, a player is similarly getting excited.

However, the amount of prize which is paid to a player according to a result of a slot game does not give such an impression to the player.

SUMMARY

The present invention has been conceived in view of the above circumstance and the object of the present invention is to provide an unprecedented novel slot machine which impresses a player with the point that a specific scatter-symbol increases on a display device while a slot game is repeated.

To achieve the object of the present invention, there is provided a slot machine comprising: a plurality of specific symbols; an accumulated number whose operand is a number of the specific symbols that have appeared; a plurality of symbols including the specific symbol; a symbol group including the symbols; a display device for displaying some of the symbols in an arranged state; a unit game in which a prize is awarded based on a total number of the same symbols which are arranged on the display device to a player; and a processor which is programmed, for progressing the unit game repeatedly with carry-over of the accumulation number, to execute each of processes from the process of (1) below to the process of (5) below: (1) selecting some of the symbols at random from the symbol group upon starting the currently unit game; (2) displaying on the display device the selected symbols in a rearranged state; (3) awarding a player a prize corresponding to a total number obtained by adding a number of the specific symbols included in the rearranged symbols to the accumulated number; (4) awarding the player a prize corresponding to a total number of the same symbols included in the rearranged symbols and finishing the current unit game; and (5) including the number of the specific symbols included in the rearranged symbols in the accumulated number upon finishing the current unit game.

Furthermore, according to another aspect of the present invention, there is provided a slot machine, comprising: a plurality of specific symbols; an accumulated number whose operand is a number of the specific symbols that have appeared; a plurality of symbols including the specific symbol; a symbol group including the symbols; a display device for displaying some of the symbols in an arranged state; a unit game in which a prize is awarded based on a total number of the same symbols which are arranged on the display device to a player; a stock area which is often displayed on the display device; a plurality of trigger symbols included in the symbols; an input device with which a player performs a normal bet operation for the unit game; a base game which composed of each of the unit games; a free game in which the unit game is repeated for a predetermined number of times continuously; and a processor which is programmed, for progressing the free game with carry-over of the accumulation number among each of the unit games that composed the free game, to execute each of processes from the process of (1) below to the process of (14) below: (1) starting the unit game which composed the base game upon finishing a normal bet operation for the unit game which composed the base game with the input device by a player; (2) selecting some of the symbols from the symbol group at random upon starting the unit game of the process of (1) above; (3) displaying on the display device the symbols selected at the process of (2) above in a rearranged state; (4) awarding the player a prize corresponding to a total number of the same symbols included in the symbols rearranged at the process of (3) above and finishing the current unit game in the basic game; (5) shifting a game mode from the base game to the free game and repeating the unit game which composed the free game for the predetermined number of times continuously, only when the number of the trigger symbols included in the symbols rearranged at the process of (3) above is equal to a predetermined number or more; (6) displaying the stock area on the display device upon shifting a game mode from the base game to the free game; (7) selecting some of the symbols from the symbol group at random upon starting the current unit game in the free game; (8) displaying on the display device the symbols selected in the process of (7) above in a rearranged state; (9) awarding the player a prize corresponding to a total number which is obtained by adding a number of the specific symbols included in the symbols rearranged at the process of (8) above to the accumulated number; (10) awarding the player a prize corresponding to a total number of the same symbols included in the symbols rearranged at the process of (8) above and finishing the current unit game in the free game; (11) upon finishing the current unit game in the free game; including the number of the specific symbols included in the symbols rearranged at the process of above (8) in the accumulated number and adding the specific symbol of the operand to the stock area, where the operand of the specific symbol is displayed; (12) determining whether or not the unit game which composed the free game has been repeated for the predetermined number of times continuously; (13) starting newly the unit game in the free game and returning to the process of (7) above if it is determined that the unit game which composed the free game has not been repeated for the predetermined number of times continuously; and (14) erasing the stock area from the display device and finishing the free game and shifting a game mode from the free game to the base game if it is determined that the unit game which composed the free game has been repeated for the predetermined number of times continuously.

Furthermore, according to another aspect of the present invention, there is provided a slot machine, comprising: a plurality of specific symbols; an accumulated number whose operand is a number of the specific symbols that have appeared; a plurality of symbols including the specific symbol; a symbol group including the symbols; a display device for displaying some of the symbols in an arranged state; a unit game in which a prize is awarded based on a total number of the same symbols which are arranged on the display device to a player; a stock area which is often displayed on the display device; a plurality of trigger symbols included in the symbols; an input device with which a player performs a normal bet operation or a side bet operation for the unit game; a base game which composed of each of the unit games; a free game in which the unit game is repeated for a predetermined number of times continuously; and a processor which is programmed, for progressing the free game with carry-over of the accumulation number among each of the unit games that composed the free game, to execute each of processes from the process of (1) below to the process of (14) below: (1) starting the unit game which composed the base game upon finishing a normal bet operation for the unit game which composed the base game with the input device by a player regardless of whether or not the player performed the normal bet operation together with a side bet operation; (2) selecting some of the symbols from the symbol group at random upon starting the unit game of the process of (1) above; (3) displaying on the display device the symbols selected at the process of (2) above in a rearranged state; (4) awarding the player a prize corresponding to a total number of the same symbols included in the symbols rearranged at the process of (3) above and finishing the current unit game in the basic game; (5) shifting a game mode from the base game to the free game and repeating the unit game which composed the free game for the predetermined number of times continuously, only when the number of the trigger symbols included in the symbols rearranged at the process of (3) above is equal to a predetermined number or more; (6) displaying the stock area on the display device upon shifting a game mode from the base game to the free game, if the player performs a side bet operation for the unit game of the process of (1) above by a bet operation which is performed by the player using the input device; (7) selecting some of the symbols from the symbol group at random upon starting the current unit game in the free game; (8) displaying on the display device the symbols selected in the process of (7) above in a rearranged state; (9) awarding the player a prize corresponding to a total number which is obtained by adding a number of the specific symbols included in the symbols rearranged at the process of (8) above to the accumulated number only when the stock area is displayed on the display device; (10) awarding the player a prize corresponding to a total number of the same symbols included in the symbols rearranged at the process of (8) above and finishing the current unit game in the free game; (11) upon finishing the current unit game in the free game, only when the stock area is being displayed on the display device; including the number of the specific symbols included in the symbols rearranged at the process of above (8) in the accumulated number and adding the specific symbol of the operand to the stock area, where the operand of the specific symbol is displayed; (12) determining whether or not the unit game which composed the free game has been repeated for the predetermined number of times continuously; (13) starting newly the unit game in the free game and returning to the process of (7) above if it is determined that the unit game which composed the free game has not been repeated for the predetermined number of times continuously; and (14) erasing the stock area from the display device and finishing the free game and shifting a game mode from the free game to the base game if it is determined that the unit game which composed the free game has been repeated for the predetermined number of times continuously.

BRIEF DESCRIPTION OF THE DRAWINGS

FIG. 3 is a schematic view showing symbol columns drawn on reel band of each reel;

FIG. 6 is a payout table in which winning combinations and the payout amounts corresponding to the winning combinations are shown when a slot game or a free game is executed by using each of the reels;

DETAILED DESCRIPTION

[1. Characteristics of the Present Invention]

Figure 1:
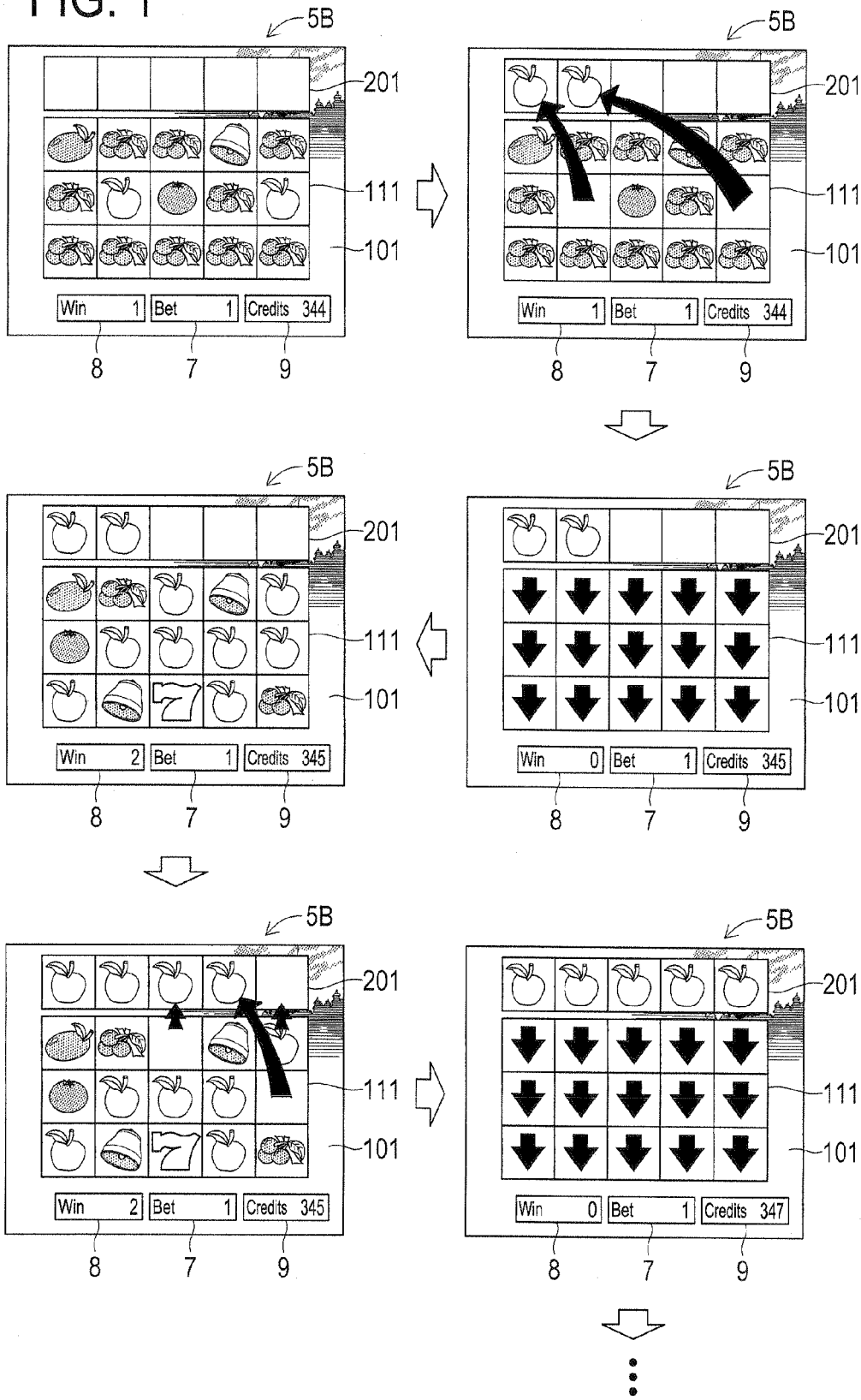
FIG. 1 is a view showing characteristics of a slot machine which is one embodiment of the present invention.

FIG. 1 is a view showing characteristics of a slot machine which is one embodiment of the present invention. Incidentally, when a liquid crystal panel 5B shown in FIG. 1 is specified, the specified liquid crystal panel 5B is described by the number of stages which counted from the uppermost stage in FIG. 1.

In the slot machine according to the present embodiment, a slot game using scatter symbols is executed as a base game. If a player wins a bonus game trigger in a slot game, a free game, in which a slot game same as above repeats automatically a predetermined number, is executed.

In the slot game, as shown in FIG. 1, a symbol display frame 111 displaying fifteen symbols is displayed on the well-known liquid crystal panel 5B. The fifteen symbols are arranged in a matrix comprising three rows by five columns. In this respect, within the symbol display frame 111, fifteen symbol display areas, where one of many symbols drawn on a reel band of one video reel is arranged, are positioned like a matrix comprising three rows by five columns. That is, one symbol display area is assigned to each of the fifteen video reels. Then, one of the symbols drawn on the reel band of each video reels is arranged in each of the symbol display areas. Further, the liquid crystal panel 5B has a bet amount display portion 7, a payout amount display portion 8 and a credit amount display portion 9. In addition, a touch panel 101 is provided on the front face of the liquid crystal panel 5B.

In the meantime, various winning combinations are previously determined based on the number of the same symbol. When each of the video reels is scrolled and stopped, a symbol is rearranged one by one in each of the symbol display areas of the symbol display frame 111, as shown on the liquid crystal panel 5B shown on the right side in the second stage or the right side in the third stage of FIG. 1. At this time, when the fifteen symbols that are rearranged in the symbol display frame 111 compose any one of the winning combinations, the payout amount is computed based on the winning combination composed and the bet amount indicated by a player. The payout amount is awarded to the player by displaying the payout amount in the payout amount display portion 8. Incidentally, the bet amount which is indicated by a player is displayed in the bet amount display portion 7. Additionally, the payout amount displayed on the payout amount display portion 8 is added to the amount in the credit amount display portion 9, and the added amount is displayed in the credit amount display portion 9.

With this, a unit game which is repeated in a base game or a free game is configured. It is to be noted that a base game and a unit game may be described as a slot game for easy explanation.

Further, when a game mode is shifted from a base game to a free game, a stock area 201 is displayed as shown on each liquid crystal panes 5B in FIG. 1. A symbol of "APPLE" which is being rearranged in the symbol display frame 111 is additionally displayed in the stock area 201.

Namely, in a free game, when the symbol of "APPLE" is rearranged in the symbol display frame 111 for the first time in one unit game, the payout amount which is awarded to a player is computed based on the number of the symbols of "APPLE" that are rearranged for the first time. The symbols of "APPLE" that are rearranged for the first time are moved to the stock area 201, and the moved symbols of "APPLE" are displayed in the stock area 201.

When the symbol of "APPLE" is rearranged in the symbol display frame 111 in any following unit game again, the payout amount which is awarded to a player is computed based on a total number of the symbols of "APPLE" which is obtained by adding the number of the symbols of "APPLE" being displayed in the stock area 201 to the number of the rearranged symbols of "APPLE". At this time, the rearranged symbols of "APPLE" are additionally displayed in the stock area 201 in addition to the symbols of "APPLE" being displayed in the stock area 201. The same operation will be carried out in the following unit games.

The above operation will be explained more specifically. As shown on each of the liquid crystal panels 5B in FIG. 1, when a game mode is shifted from a base game to a free game, the stock area 201 is displayed on the liquid crystal panel 5B. Here, as shown on the liquid crystal panel 5B shown on the left side in the first stage of FIG. 1, suppose that the symbols of "APPLE" are rearranged in the symbol display frame 111 for the first time in one unit game of a free game. In this case, as shown on the liquid panel 5B shown on the right side in the first stage of FIG. 1, the symbols of "APPLE" that are rearranged for the first time are moved to the stock area 201, and the moved symbols of "APPLE" are displayed in the stock area 201.

Incidentally, in this unit game, the number (ten) of the symbols of "CHERRY" that are rearranged in the symbol display frame 111 falls into one of the winning combinations, and the number (two) of the symbols of "APPLE" that are rearranged in the symbol display frame 111 for the first time does not fall into any of the winning combinations (refer to FIG. 6 mentioned below).

Thereafter, as shown on the liquid crystal panel 5B shown on the right side in the second stage of FIG. 1, each video reel is scrolled in each symbol display area of the symbol display frame 111, and the game mode is shifted to a next unit game. In the next unit game, as shown on the liquid crystal panel 5B shown on the left side in the second stage of FIG. 1, when the symbols of "APPLE" are rearranged in the symbol display frame 111 again, if a total number of the symbols of "APPLE" which is obtained by adding the number of the symbols of "APPLE" being displayed in the stock area 201 to the number of the rearranged symbols of "APPLE" falls into any one of the winning combinations, a payout will be awarded to a player.

In the liquid crystal panel 5B shown on the left side in the second stage of FIG. 1, a total number (nine) of the symbols of "APPLE" obtained by adding the number (two) of the symbols of "APPLE" being displayed in the stock area 201 to the number (seven) of the rearranged symbols of "APPLE" falls into one of the winning combinations (refer to FIG. 6). Therefore, a payout is awarded to a player.

Further, as shown on the liquid crystal panel 5B shown on the left side in the third stage of FIG. 1, the rearranged symbols of "APPLE" are moved to the stock area 201, and the moved symbols of "APPLE" are displayed in the stock area 201. Incidentally, the maximum number of the symbols of "APPLE" that can be displayed in the stock area 201 is five. Therefore, after the five symbols of "APPLE" are displayed in the stock area 201, the symbol of "APPLE" is not moved from the symbol display frame 111 to the stock area 201 and is not displayed in the stock area 201.

The number of the symbols of "APPLE" that can be displayed in the stock area 201 may not be limited. For example, by reducing the size of the symbol of "APPLE" in the stock area 201, the symbols of "APPLE" that are rearranged in the symbol display frame 111 may be always moved to the stock area 201 and displayed in the stock area 201.

Thereafter, as shown on the liquid crystal panel 5B shown on the right side in the third stage of FIG. 1, each video reel is scrolled in each symbol display area of the symbol display frame 111, and the game mode is shifted to a next unit game. In each of the following unit games, it will be determined whether or not a total number of the symbols of "APPLE" which is obtained by adding the number (five) of the symbols of "APPLE" being displayed in the stock area 201 to the number of the symbols of "APPLE" that will be rearranged in a unit game falls into one of the winning combinations. When a free game is finished, the stock area 201 is erased from the liquid crystal panel 5B.

[2. Construction of the Slot Machine]

Hereinafter, the one embodiment embodying the present invention will be explained in detail with reference to the drawings.

Figure 2:
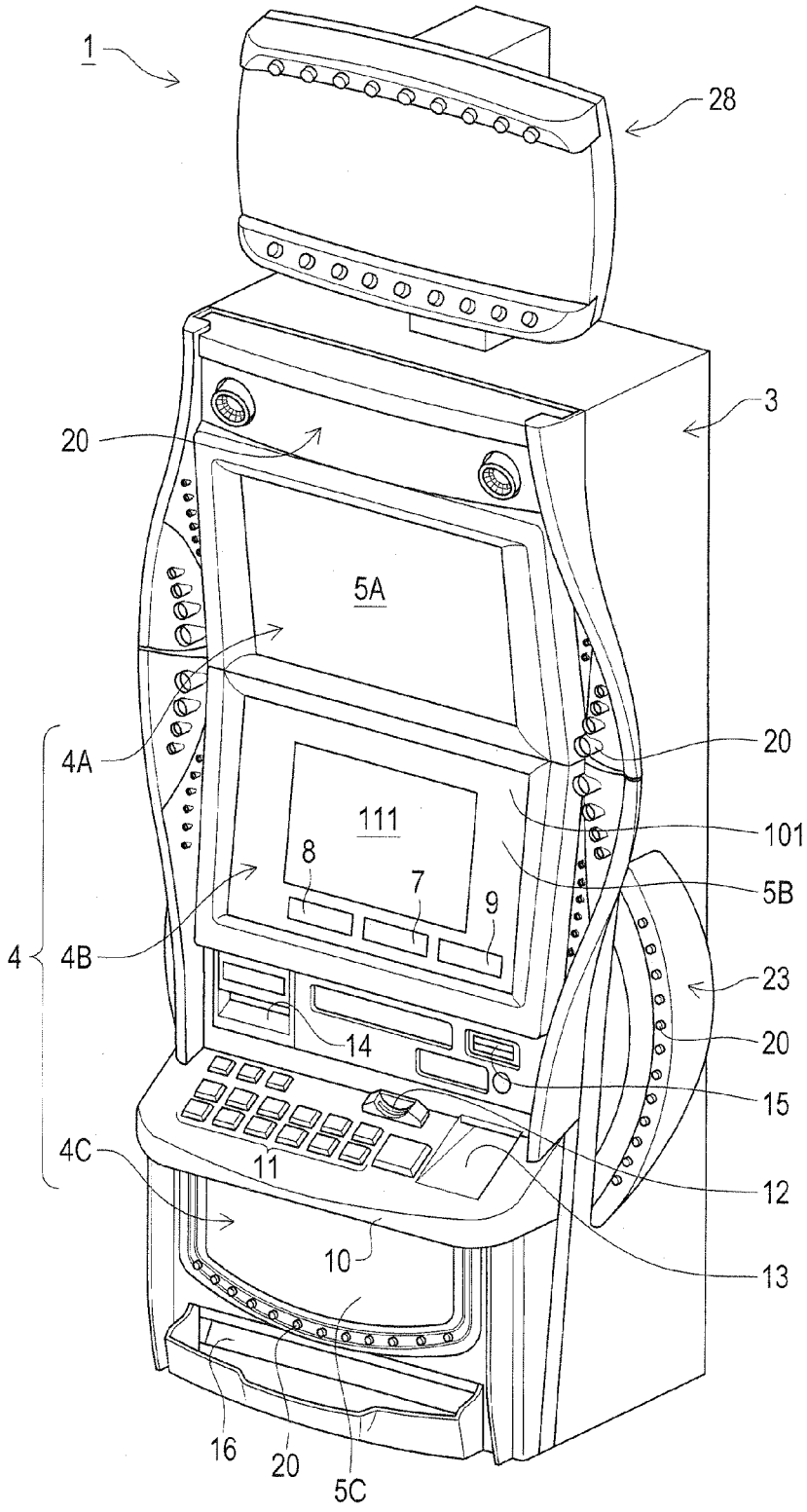
FIG. 2 is a perspective view of the slot machine.

First, an outline construction of the slot machine 1 according to the present embodiment will be explained with reference to FIG. 2. FIG. 2 is a perspective view of the slot machine 1 according to the present embodiment.

As shown in FIG. 2, the slot machine 1 is an upright type slot machine arranged in a game arcade such as casino, in order to execute predetermined game modes, such slot machine includes a cabinet 3 in which electronic and mechanical components are installed. For example, as a display portion 4 to display information concerning a game, there are provided an upper display portion 4A, a middle variable display portion 4B and a lower display portion 4C.

Each display portion 4A to 4C is mounted at the front of the oblong cabinet 3. The upper display portion 4A includes a liquid crystal panel 5A which is arranged above the middle variable display portion 4B. On the liquid crystal panel 5A, for example, an effect image, an introduction of a game content, and a rule explanation of a game are displayed. The lower display portion 4C is arranged below the middle variable display portion 4B, and includes a plastic panel 5C on which images are printed, and a plastic panel 5C is lightened by backlights.

The middle variable display portion 4B, which is used to display an execution state of a game, includes the liquid crystal panel 5B which is fixed at the front door of the cabinet 3. In this liquid crystal panel 5B, fifteen symbols of the video reels are displayed in a scrolling manner and in a stopped manner, respectively. In the middle variable display portion 4B, the symbol display frame 111 in which the fifteen symbol display areas associated with each video reel are positioned like a matrix of three rows times five columns is displayed on the liquid crystal panel 5B. Further, the touch panel 101 is provided on the front surface of the liquid crystal panel 5B. On the lower position of the middle variable display portion 4B, the bet amount display portion 7, the payout amount display portion 8 and the credit amount display portion 9 are arranged on the liquid crystal panel 5B. Also the upper portion of the middle variable display portion 4B, is related to the back side, thereby a player may play a game in a cozy posture.

Figure 7:
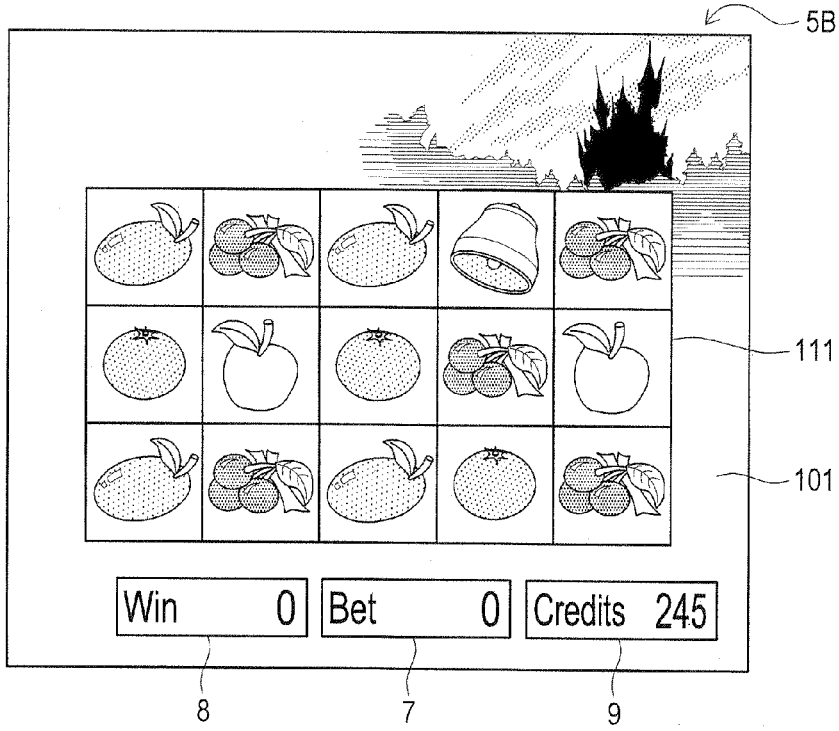
FIG. 7 is a view showing one of an image displayed on a liquid crystal panel.
Figure 8:
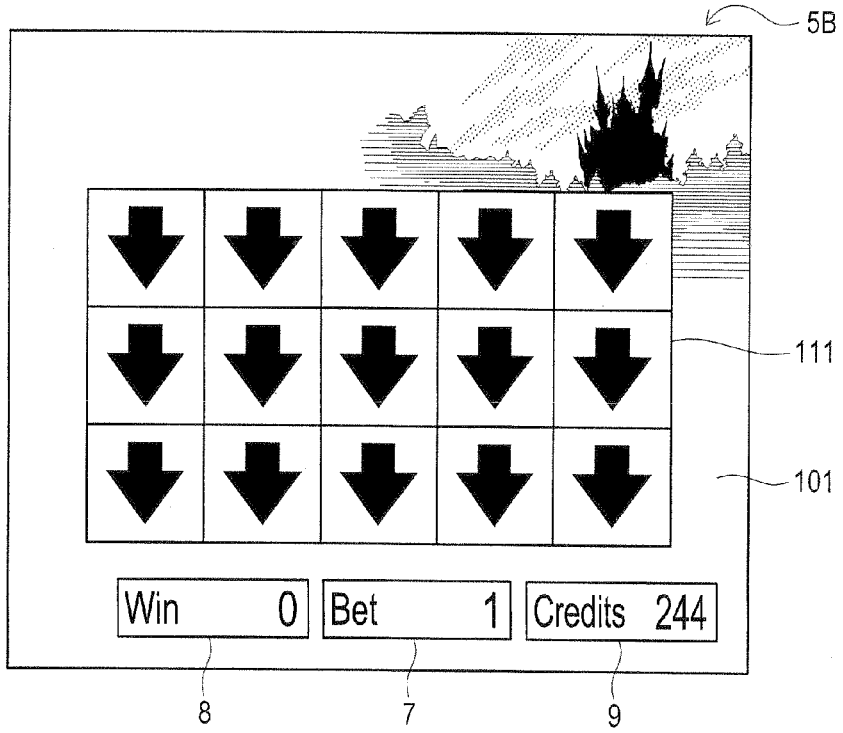
FIG. 8 is a view showing one of an image displayed on the liquid crystal panel.

Now, images of a slot game to be displayed on the liquid crystal panel 5B and images of a free game to be displayed on the liquid crystal panel 5B are explained. FIG. 7 and FIG. 8 are drawings showing contents displayed on the liquid crystal panel 5B, as one example of images of a slot game to be displayed on the liquid crystal panel 5B. As shown in FIG. 7 and FIG. 8, on the liquid crystal panel 5B in a slot game, the symbol drawn on the reel band of each video reel is displayed in the fifteen symbol display areas positioned like a matrix of three rows times five columns in the symbol display frame 111, so that they can be viewed by a player. FIG. 7 shows a state in which the symbol drawn on the reel band of each video reel is arranged or rearranged in each symbol display area of the symbol display frame 111 on the liquid crystal panel 5B. FIG. 8 shows a state in which the symbol drawn on the reel band of each video reel is displayed by a scrolling manner in each symbol display area of the symbol display frame 111 on the liquid crystal panel 5B. Incidentally, on the reel band of each video reel, a symbol column constructed from twenty-two symbols is drawn respectively (refer to FIG. 3).

Further, the bet amount display portion 7, the payout amount display portion 8 and the credit amount display portion 9 are arranged on the liquid crystal panel 5B. On the bet amount display portion 7, the bet amount which is indicated by the current player is displayed. On the payout amount display portion 8, the payout amount awarded in a slot game to a player is displayed. On the credit amount display portion 9, the credit amount which is owned by the current player is displayed.

Therefore, on the liquid crystal panel 5B in a slot game, one symbol which is drawn on the reel band of each video reel is arranged in each of the fifteen symbol display areas of the symbol display frame 111.

Figure 9:
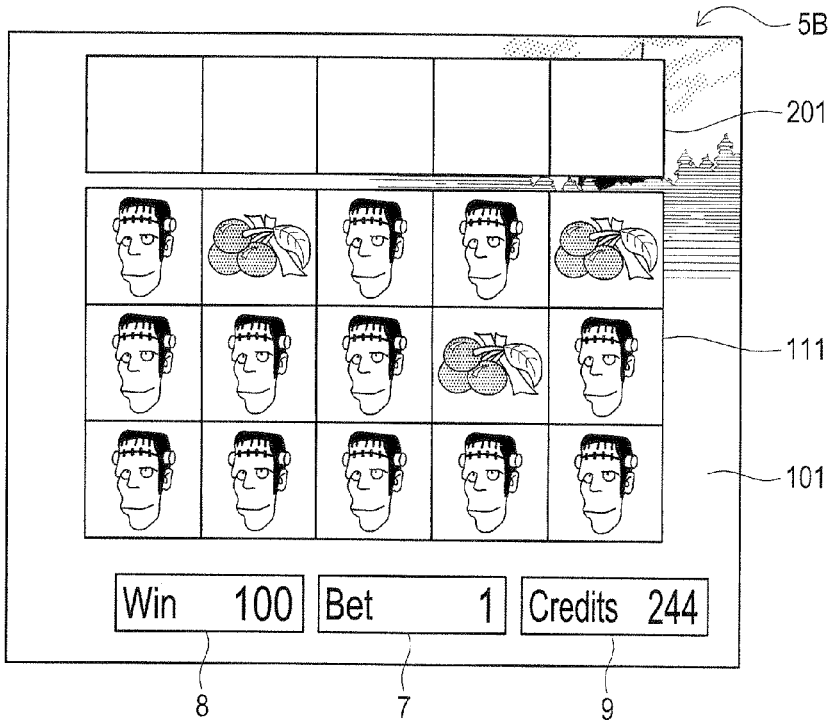
FIG. 9 is a view showing one of an image displayed on the liquid crystal panel.
Figure 10:
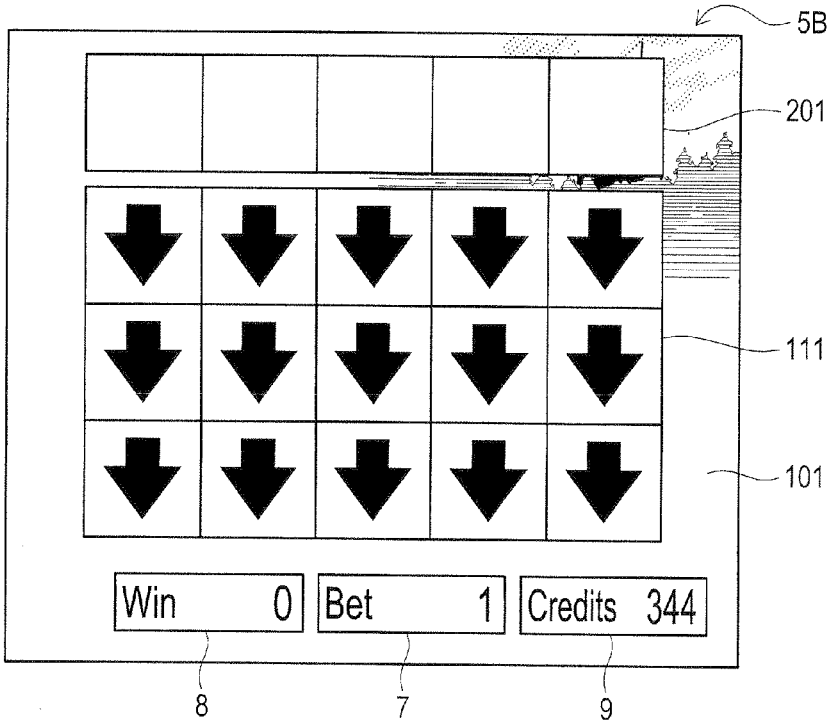
FIG. 10 is a view showing one of an image displayed on the liquid crystal panel.

FIG. 9 and FIG. 10 shows drawings showing contents displayed on the liquid crystal panel 5B, as one example of images of a free game to be displayed on the liquid crystal panel 5B. On the liquid crystal panel 5B, the stock area 201 is displayed above the symbol display frame 111, as shown in FIG. 9, after a game mode is shifted to a free game. Further, the stock area 201 is continuously displayed on the liquid crystal panel 5B in a free game. The maximum number of the symbols of "APPLE" displayed in the stock area 201 is five. Incidentally, images relating to a free game are same as those relating to a slot game except for the stock area 201, so the explanation thereof will be omitted.

Returning to FIG. 2, between the middle variable display portion 4B and the lower display portion 4C, at the front of the cabinet 3, an operation table 10 which is projected forward is arranged. On the operation table 10, a variety of operation buttons 11 including a BET button, a collecting button, a spin button, a CASHOUT button, and a side BET button are arranged as an operation portion to execute a game. On the operation table 10, a coin insertion slot 12 and a bill insertion slot 13 are arranged. Also between the operation table 10 and the middle variable display portion 4B, a ticket printer 14, a card reader 15 and a reader/writer 15 are arranged. At the lowest position of the cabinet 3, a coin tray 16 is also arranged.

Incidentally, in the slot machine 1 of the present embodiment, gaming medium may be coin, bill, or electronic value (credit). Here, the gaming medium may be others as well, such as medal, token, electronic money, or ticket.

Further, on the cabinet 3 of the slot machine 1, light emitting portions 20 are arranged around a game area including the upper display portion 4A, the middle variable display portion 4B, the lower display portion 4C and the operation table 10.

Furthermore, the slot machine 1 also includes a topper effect device 28 which is installed on the cabinet 3. The topper effect device 28 is shaped in a rectangular board shaped, and is arranged almost parallel to the liquid crystal panel 5A of the upper display portion 4A. The cabinet 3 is further provided with speakers 23 on its both sides.

[3. Outline of Symbols]

Next, the symbols drawn on the reel band of each video reel will be explained with reference to FIG. 3. These symbols are scrolled and rearranged in the respective symbol display areas of the symbol display frame 111 on the liquid crystal panel 5B in a slot game or a free game. FIG. 3 is a schematic view showing symbol columns drawn on the reel band of each video reel.

On the reel band of each video reel, twenty-two symbols are arranged respectively. Each symbol column of video reel is constructed from the symbols including "FRANKENSTEIN", "BLUE7", "BELL", "APPLE", "CHERRY", "ORANGE" and "PLUM". And the symbols of predetermined types are arranged in a predetermined sequence. In other words, a symbol group is composed of each of the symbols of "FRANKENSTEIN", "BLUE7", "BELL", "APPLE", "CHERRY", "ORANGE" and "PLUM".

In this respect, each of the symbols of "FRANKENSTEIN", "BLUE7", "BELL", "APPLE", "CHERRY", "ORANGE" and "PLUM" is a scatter symbol. When more than nine or ten symbols of "FRANKENSTEIN", "BLUE7", "BELL", "APPLE", "CHERRY", "ORANGE" and "PLUM" are rearranged in the symbol display frame 111 of the liquid crystal panel 5B, a predetermined payout amount is awarded to a player (refer to FIG. 6).

In addition, the symbol of "APPLE" is a specific symbol. As mentioned above, when the symbol of "APPLE" is rearranged in the symbol display frame 111 of the liquid crystal panel 5B, the symbol of "APPLE" is additionally displayed in the stock area 201 of the liquid crystal panel 5B.

Incidentally, to each symbol composing the symbol column of each video reel shown in FIG. 3, a code number is allocated from top to down in sequence.

[4. Internal construction of the Slot Machine]

Next, an internal construction of the above slot machine 1 will be explained with reference to FIG. 4 and FIG. 5.

Figure 4:
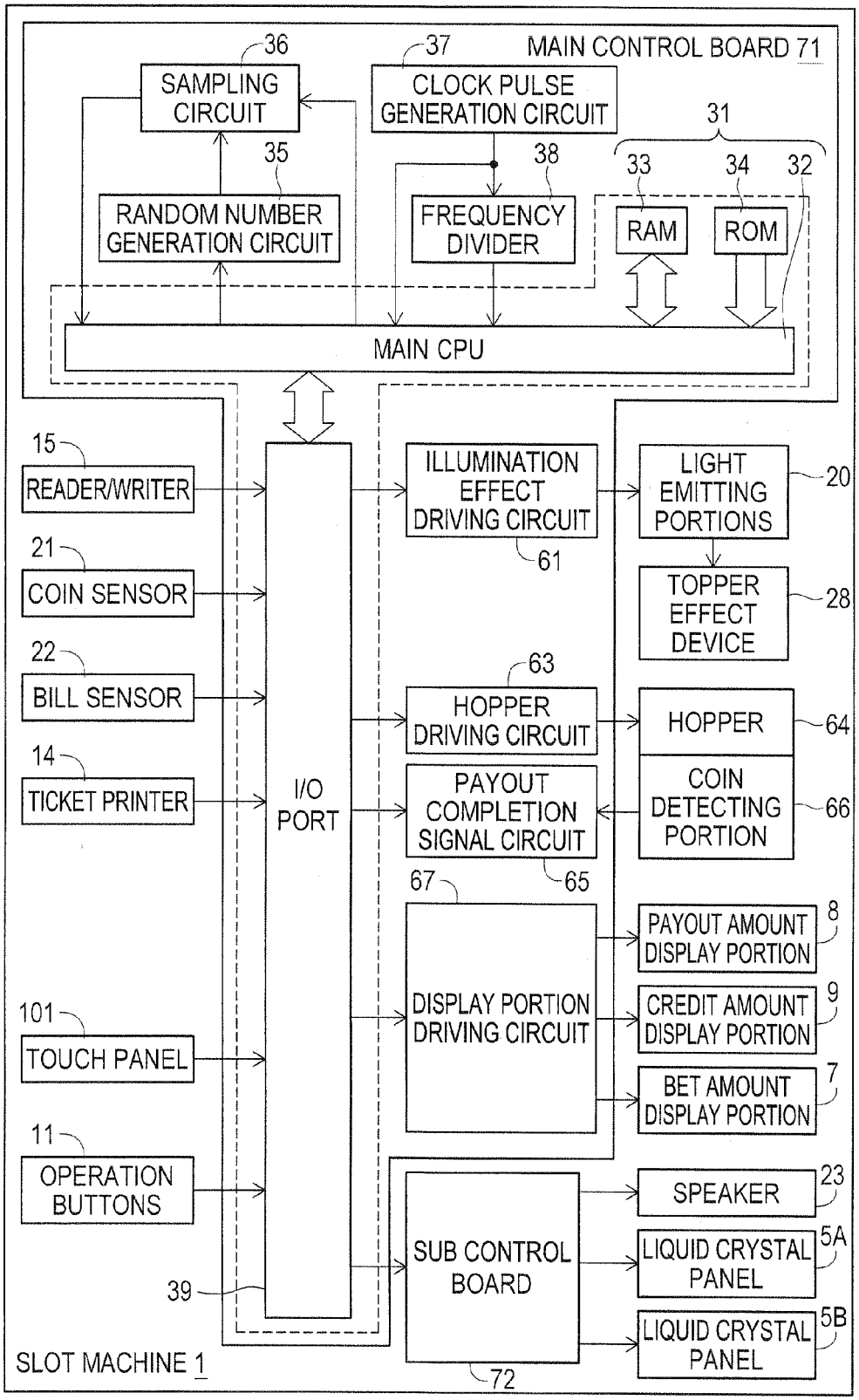
FIG. 4 is a block diagram showing an internal construction of entire slot machine.

FIG. 4 is a block diagram showing an internal construction of entire slot machine 1. As shown in FIG. 4, the slot machine 1 includes a plurality of construction elements such as a main control board 71, in which a microcomputer 31 is included. The main control board 71 is constructed from the microcomputer 31, a random number generation circuit 35, a sampling circuit 36, a clock pulse generation circuit 37 and a frequency divider 38. The main control board 71 also includes an illumination effect driving circuit 61, a hopper driving circuit 63, a payout completion signal circuit 65 and a display portion driving circuit 67.

The microcomputer 31 is constructed from a main CPU 32, a RAM 33 and a ROM 34. The main CPU 32 runs based on programs stored in the ROM 34, and inputs/outputs a signal with other elements through an I/O port 39, so as to execute control of the entire slot machine 1. Data and programs used when the main CPU 32 runs are stored in the RAM 33. For example, after-mentioned random numbers which are sampled by the sampling circuit 36 are stored temporarily after a start of a game, also the code numbers of the respective video reels and the symbol numbers are stored in the RAM 33. Further, the RAM 33 sets in advance a storage area where each of after-mentioned variables N, M, L and an after-mentioned accumulated number are stored. Programs executed by the main CPU 32 and permanent data are stored in the ROM 34.

Especially, the programs stored in the ROM 34 include game programs and game system programs (abbreviated as "the game programs and the like" hereinafter). Further, a lottery programs mentioned below is also included in the game programs.

The lottery program is a program used to determine the code numbers of the respective video reels which corresponds to each symbol rearranged in the respective symbol display areas of the symbol display frame 111 on the liquid crystal panel 5B. Then, in the lottery program, it is included symbol weighing data corresponding to each of plural kinds of payout rates (for example, 80%, 84%, and 88%). The symbol weighing data are the data indicating correlation between the code number of each video reel and one or plural random numbers belonging to a predetermined number range (0 to 255), every each of the fifteen video reels. In other words, each of the code number of one video reel is associated with one or more random numbers corresponding to the payout rate. The random numbers are extracted by the lottery program, and symbols specified finally by the random numbers are rearranged in the respective symbol display areas of the symbol display frame 111 on the liquid crystal panel 5B.

Random numbers over a predetermined range are generated by the random number generation circuit 35, which is operated based on instructions from the main CPU 32. The random numbers are voluntarily extracted from the random numbers generated by the random number generation circuit 35 by the sampling circuit 36, based on instructions from the main CPU 32, and the extracted random numbers are input to the main CPU 32. The base clock for running the main CPU 32 is generated by the clock pulse generation circuit 37, and signals which are generated by dividing the base clock in a predetermined frequency are input to the main CPU 32 by the frequency divider 38.

And to the main control board 71, the touch panel 101 is connected. The touch panel 101 is arranged in front of the liquid crystal panel 5B, and specifies the coordinate position of the portion touched by a player. The position on which a player touched and the direction of the movement of the touched portion are determined based on the specified coordinate position information. A signal corresponding to the determination is input to the main CPU 32 through the I/O port 39.

Also, the operation buttons 11 for instructing an execution of a game are connected to the main control board 71. The operation buttons 11 include the spin button, the collecting button, the BET button and the side BET button and the like. A signal corresponding to the depressing of these buttons is input to the main CPU 32 through the I/O port 39.

A ticket printer 14, a reader/writer 15, a coin sensor 21 and a bill sensor 22 are connected to the main control board 71. The reader/writer 15 reads information from an IC card and writes information in an IC card. The ticket printer 14 prints tickets with bar codes. The bill sensor 22 detects a bill inserted to the bill slot 13 one by one and sends a signal corresponding to the detection to the main CPU 32 via the I/O port 39. The coin sensor 21 detects a coin inserted to the coin slot 12 one by one and sends a signal corresponding to the detection to the main CPU 32 via the I/O port 39.

An effect signal which is used to conduct illumination effect is output to the above-mentioned light emitting portions 20 and the topper effect device 28 by the illumination effect driving circuit 61. Then, the topper effect device 28 is serially connected to the illumination effect driving circuit 61 through the light emitting portions 20.

A hopper 64 is driven by the hopper driving circuit 63 based on control of main CPU 32. The hopper 64 executes payout of coins, and coins are paid out from the coin tray 16. Data of the number of coins are input from the connected coin detecting portion 66 by the payout completion signal circuit 65. When the number of coins becomes a predetermined number, a signal indicating completion of the coins is input to the main CPU 32. The number of the coins paid out from the hopper 64 is calculated by the coin detecting portion 66, and the data of the number calculated are input to the payout completion signal circuit 65. The each display operation of the bet amount display portion 7, payout amount display portion 8 and credit amount display portion 9 is controlled by the display portion driving circuit 67.

Furthermore, a sub control board 72 is connected to the main control board 71. The sub control board 72 is connected to the liquid crystal panel 5A, the liquid crystal panel 5B and the speakers 23.

Figure 5:
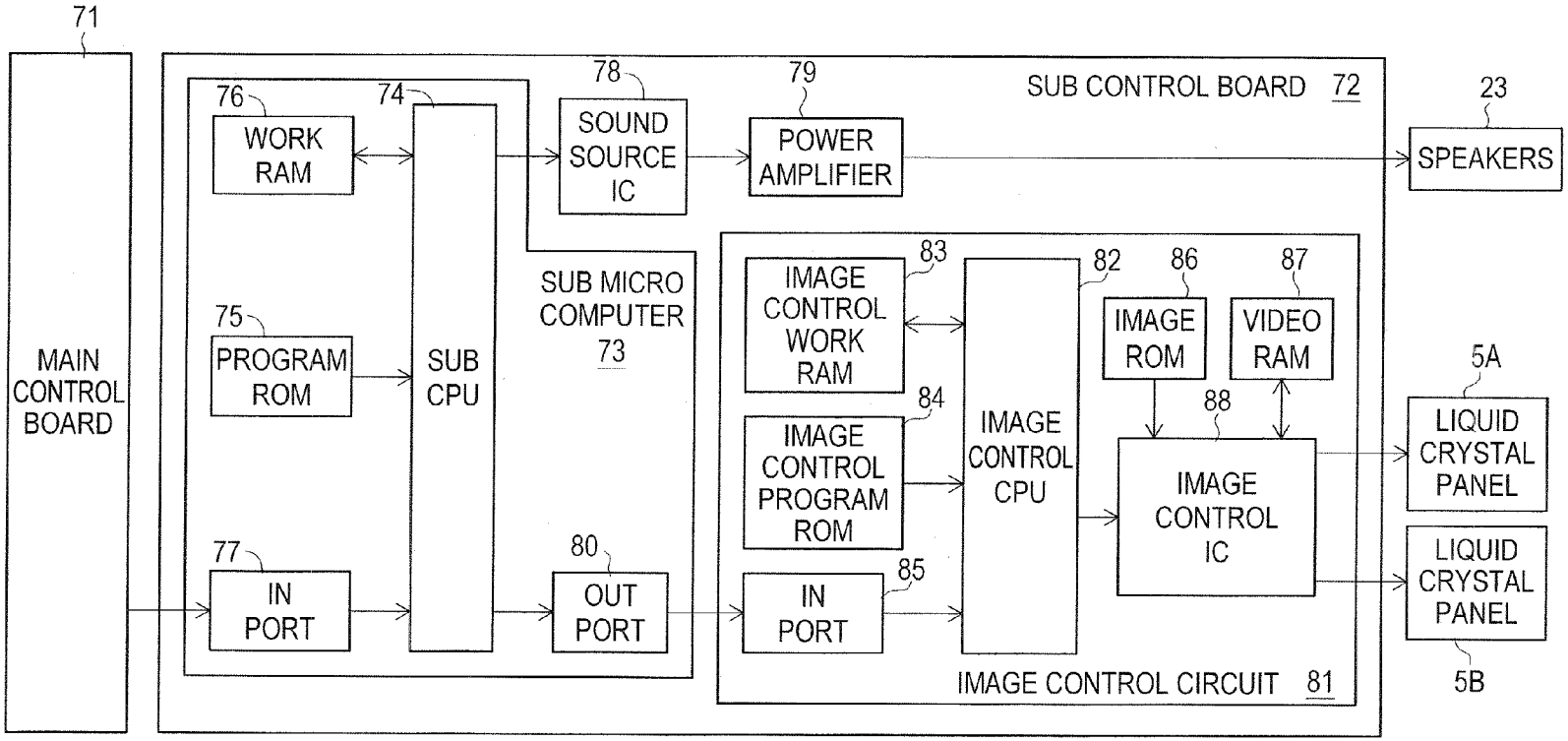
FIG. 5 is a block diagram showing an internal construction of a sub control board.

FIG. 5 is a block diagram showing an internal construction of the sub control board 72. As shown in FIG. 5, a command from the main control board 71 is input to the sub control board 72. The display control on the liquid crystal panel 5A of the upper display portion 4A and the liquid crystal panel 5B of the variable display portion 4B, and the sound output control on the speaker 23 are executed by the sub control board 72. The sub control board 72 is constructed on a circuit board different from the circuit board for the main control board 71, and includes a microcomputer 73 (abbreviated as "sub-microcomputer" hereinafter) as a main construction element, and a sound source IC 78, a power amplifier 79 and an image control circuit 81. The sound source IC 78 controls the sound output from the speakers 23, the power amplifier 79 is used as an amplification device, and the image control circuit 81 runs as a display control device of the liquid crystal panel 5A and 5B.

The sub-microcomputer 73 includes a sub CPU 74, a program ROM 75, a work RAM 76, an IN port 77 and an OUT port 80. The control operations are executed by the sub CPU 74 based on a control order sent from the main control board 71, the program ROM 75 is used as a memory device.

Although a clock pulse generation circuit, a frequency divider, a random number generation circuit and a sampling circuit are not included in the sub control board 72, the sub control board 72 is constructed so as to execute random number sampling according to operation programs thereof. Control programs executed by the sub CPU 74 are stored in the program ROM 75. The work RAM 76 is constructed as a temporary storing device when the above control programs are executed by the sub CPU 74.

The image control circuit 81 includes an image control CPU 82, an image control work RAM 83, an image control program ROM 84, an IN port 85, an image ROM 86, a video RAM 87 and an image control IC 88. Images displayed on the liquid crystal panel 5A and 5B are determined by the image control CPU 82, based on parameters set by the sub-microcomputer 73, according to image control programs stored in the image control program ROM 84.

The image control programs regarding to a display of the liquid crystal panel 5A, 5B and a variety of selection tables are stored in the image control program ROM 84. The image control work RAM 83 is constructed as a temporary storing device when the image control programs are executed by the image control CPU 82. Images corresponding to contents determined by the image control CPU 82 are formed by the image control IC 88, and are output to the liquid crystal panel 5A, 5B.

In the image ROM 86, dot data used to form images are stored. Thus, it stores the dot data on symbols drawn on the reel band of the each video reel. The video RAM 87 runs as a temporary storing device when the images are formed by the image control IC 88.

Further, based on a control signal from the main CPU 32, the image control circuit 81 performs display control of scrolling display/stop display of the video reels in the respective symbol display areas of the symbol display frame 111 on the liquid crystal panel 5B. In addition, based on a control signal from the main CPU 32, the image control circuit 81 executes display control to display the symbol of "APPLE" additionally in the stock area 201 of the liquid crystal panel 5B.

[5. Outline of a Slot Game]

Next, winning combinations and the payout amounts corresponding to the winning combinations will be explained with reference to FIG. 6, wherein the winning combinations are symbol combinations when a slot game or a free game is executed by using each of the video reels in the slot machine 1 according to the present embodiment. FIG. 6 is a payout table in which the winning combinations and the payout amounts corresponding to the winning combinations are shown when a slot game or a free game is executed by using each of the video reels.

Here, the payout amount shown in FIG. 6 indicates the payout amount when the bet amount is "1". Therefore, when the bet amount is "1", the payout amount shown in FIG. 6 is paid out, and when the bet amount is more than "2", the payout amount obtained by multiplying the payout amount shown in FIG. 6 with the bet amount is paid out.

Therefore, when fifteen symbols of "FRANKENSTEIN" are rearranged in the symbol display frame 111 of the liquid crystal panel 5B, an amount obtained by multiplying 500 credits by the bet amount is paid out. Further, if the fourteen symbols of "FRANKENSTEIN" are rearranged in the symbol display frame 111 of the liquid crystal panel 5B, an amount obtained by multiplying 300 credits by the bet amount is paid out. In the following, similarly, according to the number of the symbols of "FRANKENSTEIN" rearranged in the symbol display frame 111 of the liquid crystal panel 5B, the payout amounts as shown in FIG. 6 are set.

Also for each symbol of "BLUE7", "BELL", "APPLE", "CHERRY", and "PLUM", similarly in the following, the payout amounts as shown in FIG. 6 are set according to the number of same symbols rearranged in the symbol display frame 111 of the liquid crystal panel 5B. However, if the number of same symbols rearranged in the symbol display frame 111 of the liquid crystal panel 5B is not any of the numbers shown in FIG. 6, it means a loss, and no payout is made to a loss.

In addition, the symbol of "FRANKENSTEIN" is a trigger symbol. Therefore, in a slot game, if the number of the symbols of "FRANKENSTEIN" rearranged in the symbol display frame 111 of the liquid crystal panel 5B is twelve or more, a player wins a bonus game trigger. A predetermined payout amount is awarded to the player, and a game mode shifts from a slot game to a free game.

As mentioned above, in the slot machine 1 according to the present embodiment, a slot game is executed.

In other words, in a slot game, the slot game is executed by rearranging the plurality of same symbols specified by fifteen video reels in the symbol display frame 111 of the liquid crystal panel 5B. In the slot game, firstly, a part of symbol column (one symbol) drawn on the reel band of each video reel (shown in FIG. 3), is arranged in each symbol display area of the symbol display frame 111 on the liquid crystal panel 5B (refer to FIG. 7). Here, after a player sets the bet amount by depressing the BET button among the operation buttons 11, if the player depresses the spin button among the operation buttons 11, each of the video reels rotates, the symbol column drawn on the reel band of each video reel shown in FIG. 3, is scrolled from up to down in the symbol display frame 111 of the liquid crystal panel 5B (refer to FIG. 8).

After a predetermined time, each of the video reels stops automatically, a part of symbol column (one symbol) drawn on the reel band of each video reel shown in FIG. 3, is rearranged in each symbol display area of the symbol display frame 111 on the liquid crystal panel 5B (refer to FIG. 7). On the other hand, each winning combination based on each the number of the same symbol is determined beforehand (refer to FIG. 6). When a symbol combination constructed from the fifteen symbols rearranged in the symbol display frame 111 of the liquid crystal panel 5B, realizes a winning combination specified by the number of the same symbol, the payout amount obtained by multiplying the bet amount with the payout amount corresponding to the realized winning combination is awarded to the player.

However, if the symbol of "APPLE" is rearranged in the symbol display frame 111 of the liquid crystal panel 5B, the symbol of "APPLE" is displayed additionally in the stock area 201 of the liquid crystal panel 5B.

On the other hand, a free game, in which a slot game same as above is repeated a predetermined number of times (ten times, in the embodiment), is executed upon the player's winning a bonus game trigger in a slot game. Also, in the slot game, firstly, a part of symbol column (one symbol) drawn on the reel band of each video reel shown in FIG. 3, is arranged in each symbol display area of the symbol display frame 111 on the liquid crystal panel 5B (refer to FIG. 9). However, here, after a predetermined time, each of the video reels rotates automatically. Thereby, no matter whether a player presses the operation buttons 11 such as the BET button or the spin button, the symbol column drawn on the reel band of each video reel shown in FIG. 3, is scrolled from up to down in the symbol display frame 111 of the liquid crystal panel 5B (refer to FIG. 10).

Furthermore, after a predetermined time, each of the video reels stops automatically, so a part of symbol column (one symbol) drawn on the reel band of each video reel shown in FIG. 3 is rearranged in each symbol display area of the symbol display frame 111 on the liquid crystal panel 5B (refer to FIG. 9). On the other hand, similar to the above slot game, each winning combination based on each the number of the same symbol is determined beforehand (refer to FIG. 6). When a symbol combination constructed from the fifteen symbols rearranged in the symbol display frame 111 of the liquid crystal panel 5B, realizes a winning combination specified by the number of the same symbol, the payout amount obtained by multiplying the bet amount with the payout amount corresponding to the realized winning combination is awarded to the player.

Incidentally, in a free game, a player may win a bonus game trigger. However, in the present embodiment, only when a player wins a bonus game trigger for the first time in a free game, a predetermined number of times which a slot game is repeated in the free game is increased from ten to fifteen. Therefore, even if a player may win a bonus game trigger in the free game again, the predetermined number of times which a slot game is repeated in the free game is not increased from fifteen.

[6. Operation of the Slot Machine]

Figure 11:
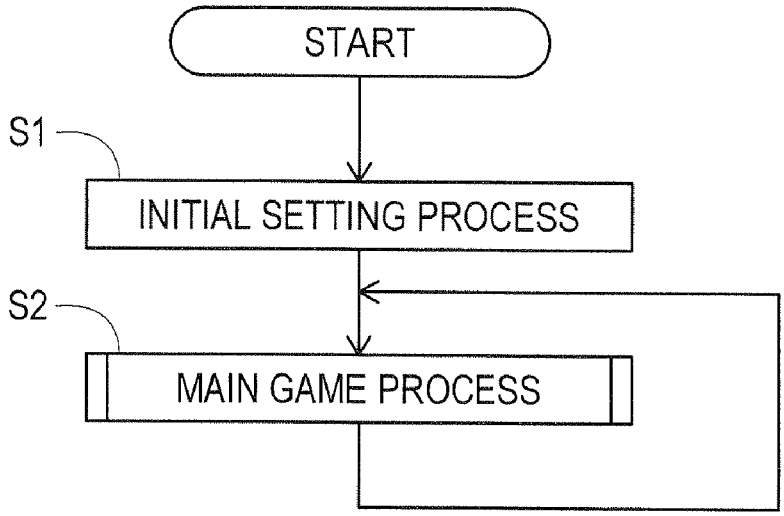
FIG. 11 is a flowchart of a main control program.

Next, a main control program executed in the slot machine 1 according to the present embodiment will be explained with reference to drawings. FIG. 11 is a flowchart of the main control program.

First, when a power switch is pressed (power activation), the microcomputer 31 is started to operate, an initial setting process is executed by the microcomputer 31 in step (abbreviated as "S") 1. In the initial setting process, BIOS stored in the ROM 34 is executed by the main CPU 32. Compressed data included in the BIOS are expanded to the RAM 33, and when the BIOS expansion to the RAM 33 is executed, a diagnosing process and initialization process of various peripheral devices are executed. Also, the game programs and the like are written from the ROM 34 to the RAM 33 by the main CPU 32, so as to obtain the payout rate setting data and country ID information. Also, during execution of the initial setting process, a verification process to each program is executed.

Then in S2, the main CPU 32 reads out the game programs and the like from the RAM 33, and executes the programs in sequence so as to conduct the main game process. A game is executed in the slot machine 1 according to the present embodiment by executing the main game process. Then, the main game process is repeated when the power is supplied to the slot machine 1.

Figure 12:
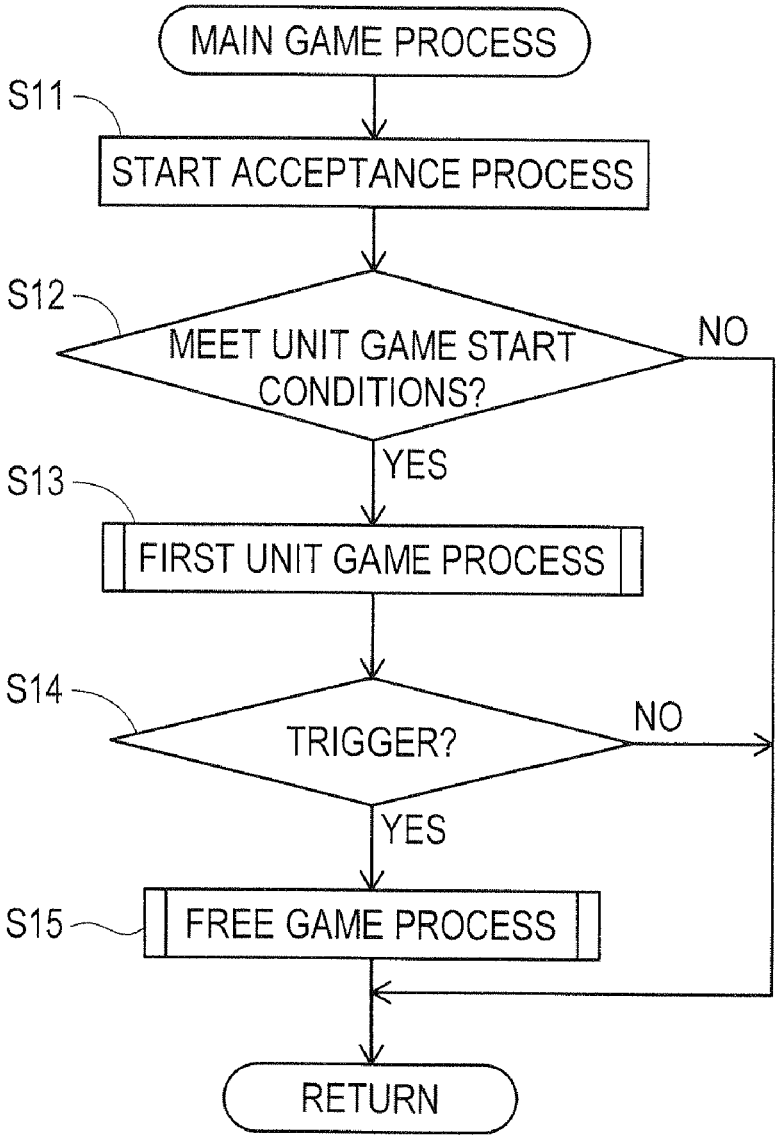
FIG. 12 is a flowchart of a main game process program.

Next, a sub process of the main game process in S2 above will be explained with reference to FIG. 12. FIG. 12 is a flowchart of the main game process program in the slot machine 1 according to the present embodiment. Incidentally, each program shown in the flowchart of FIG. 12 is stored in the ROM 34 or the RAM 33 of the slot machine 1, and is executed by the main CPU 32.

First, as shown in FIG. 12, a start acceptance process is executed by the main CPU 32. At this time, in the start acceptance process, an insertion of coins or a bet operation using the BET button or the side BET button among the operation buttons 11 is executed by a player.

Then, in S12, the main CPU 32 determines whether or not unit game start conditions are met. Here, the unit game start conditions are that the spin button among the operation buttons 11 is depressed. Accordingly, this determination is made based on a signal which is input to the main CPU 32 depending on depressing the operation buttons 11. At this point, if the spin button among the operation buttons 11 is not depressed (S12: NO), the process returns to the start acceptance process (S11) again. Thereby, an operation of changing the bet amount and an operation of setting the side bet amount and the like are possible. In contrast, if the spin button among the operation buttons 11 is depressed (S12: YES), the bet amount set based on the above bet operation is reduced from the credit amount owned by the player at the moment, and is stored in the RAM 33 as bet information. Incidentally, the credit amount after the reduction is also stored in the RAM 33 as credit information. Then, by sending a control signal to the display portion driving circuit 67, the main CPU 32 displays the credit information stored in the RAM 33 (the credit amount after the above reduction) on the credit amount display portion 9 of the liquid crystal panel 5B.

Figure 13:
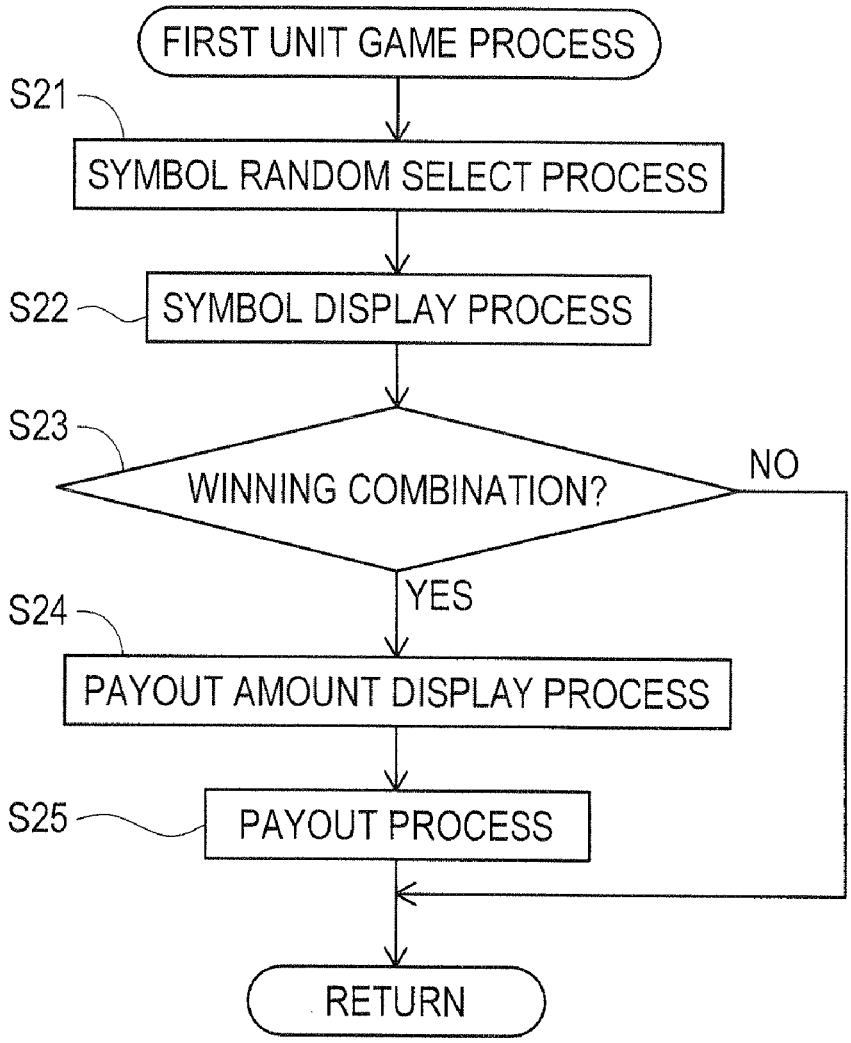
FIG. 13 is a flowchart of the first unit game process program.

Then, when the process proceeds to S13, the main CPU 32 executes a first unit game process. So, a sub process of the first unit game process will be explained based on FIG. 13. FIG. 13 is a flowchart of the sub process of the first unit game process program in the slot machine 1 according to the present embodiment. Incidentally, a program shown in the flowchart of FIG. 13 is stored in the ROM 34 or the RAM 33 of the slot machine 1, and is executed by the main CPU 32.

First, in the first unit game process of S13 above, as shown in FIG. 13, the main CPU 32 executes a symbol random select process in S21. Specifically, when the lottery program included in the game programs is executed by the main CPU 32, the random number corresponding to each video reel respectively is selected from a range of "0 to 255". Then, with reference to the symbol weighting data corresponding to the payout rate setting data, based on the fifteen random numbers, the code number of each video reel is determined by the main CPU 32. The main CPU 32 stores the determined code number of each video reel in the RAM 33 by overwriting code number information in the RAM 33 with the determined code number of each video reel so as to correspond to each symbol display area of the symbol display frame 111 on the liquid crystal panel 5B. Thereafter, the process proceeds to S22.

Here, the code number of each video reel is associated with the symbol number to be rearranged in each symbol display area of the symbol display frame 111 on the liquid crystal panel 5B, so each symbol to be rearranged in such game is determined by overwriting the code number information in the RAM 33 with the code number of each video reel determined by the main CPU 32 so as to correspond to each symbol display area of the symbol display frame 111 on the liquid crystal panel 5B. For example, if the main CPU 32 determines that all of the code number of each video reel are "21" and then overwrites the code number information in the RAM 33 with the code number of each video reel so as to correspond to each symbol display area of the symbol display frame 111 on the liquid crystal panel 5B, the main CPU 32 determines to rearrange the fifteen symbols of "FRANKENSTEIN" (refer to FIG. 3). Thus, by overwriting the code number information in the RAM 33 with the code number of each video reel selected by a lottery so as to correspond to each symbol display area of the symbol display frame 111 on the liquid crystal panel 5B, each symbol to be rearranged in a unit game of a slot game is determined.

Subsequently, when proceeding to S22, the main CPU 32 executes a symuol display process. In other words, by sending a control signal to the sub control board 72, the main CPU 32 starts a scrolling display of each video reel in each symbol display area of the symbol display frame 111 on the liquid crystal panel 5B. After that, an effect mode (a display mode of images on the liquid crystal panel 5B and a sound output mode from the speakers 23) for each unit game is determined by the main CPU 32, and the sub control board 72 is ordered to start the effect in a predetermined effect pattern. Then, when a predetermined timing to stop displaying each video reel in scrolling manner comes, the main CPU 32, by sending a control signal to the sub control board 72, stops scrolling of each video reel being displayed. The stop operation is based on the code number stored in the RAM 33 by overwriting the code number information in the RAM 33 with the code number so as to correspond to each symbol display area of the symbol display frame 111 on the liquid crystal panel 5B. With this, each symbol which determined in S21 above-mentioned is rearranged in each symbol display area of the symbol display frame 111 on the liquid crystal panel 5B.

After that, when proceeding to S23, the main CPU 32 determines whether or not there is a winning combination. The determination is made based on the code number stored in the RAM 33 by overwriting the code number information in the RAM 33 with the code number so as to correspond to each symbol display area of the symbol display frame 111 on the liquid crystal panel 5B. At this point, if there is not a winning combination (S23: NO), the process returns to the above-mentioned main game process of FIG. 12. In contrast, if there is a winning combination (S23: YES), the process proceeds to S24.

In S24, the main CPU 32 executes a payout amount display process. Specifically, first, the payout amount obtained by multiplying the payout amount corresponding to the winning combination (the number of the same symbol) rearranged in the symbol display frame 111 of the liquid crystal panel 5B with the bet amount is computed. Incidentally, the computation is executed based on the bet information in the RAM 33 and the payout table of FIG. 6. In case that there is more than one payout amount corresponding to the winning combination (the number of the same symbol), the computation is executed by adding up these payout amounts. The computed payout amount is stored in RAM 33 as payout information. After that, by sending a control signal to the display portion driving circuit 67, the main CPU 32 displays the payout information stored in the RAM 33 (the above-mentioned computed amount) on the payout amount display portion 8 of the liquid crystal panel 5B.

Then, the main CPU 32 executes a payout process in S25. In the payout process, the payout amount awarded to a player in a slot game is paid out to the player based on the payout information stored in the RAM 33.

When the pay out is executed, the credit amount stored in the RAM 33 as the payout information (the payout amount awarded to a player in a slot game) are added to the credit amount stored in the RAM 33 as the credit information, and the added value is overwritten in the RAM 33 as the credit information. After that, by sending a control signal to the display portion driving circuit 67, the main CPU 32 displays the credit information stored in the RAM 33 (the added value computed in S25) on the credit amount display portion 9 of the liquid crystal panel 5B. At the same time, the main CPU 32 overwrites "0" to the RAM 33 as the payout information, and displays "0" on the payout amount display portion 8 of the liquid crystal panel 5B by sending a control signal to the display portion driving circuit 67.

Incidentally, in the payout process, the credit amount owned by a player at the moment may be paid out by coins corresponding to the credit amount (one credit equals to one coin) based on the player's depressing the CASHOUT button among the operation buttons 11, or may also be paid out by a ticket with a bar code which is printed by the ticket printer 14.

Then, after the main CPU 32 executes the above-mentioned payout process in S25, the process returns to the above-mentioned main game process of FIG. 12.

Returns to the above-mentioned FIG. 12, in S14, the main CPU 32 determines whether or not a player wins a bonus game trigger. Specifically, if the number of the symbols of "FRANKENSTEIN" rearranged in the symbol display frame 111 of the liquid crystal panel 5B is twelve or more, it is determined that a player wins a bonus game trigger. Incidentally, the determination also is made based on the code number stored in the RAM 33 by overwriting the code number information in the RAM 33 with the code number so as to correspond to each symbol display area of the symbol display frame 111 on the liquid crystal panel 5B. At this point, if a player wins no bonus game trigger (S14: NO), the process returns to the start acceptance process (S11) again. In contrast, if a player wins a bonus game trigger (S14: YES), the process returns to the start acceptance process (S11) again via an after-mentioned free game process in S15.

Figure 14:
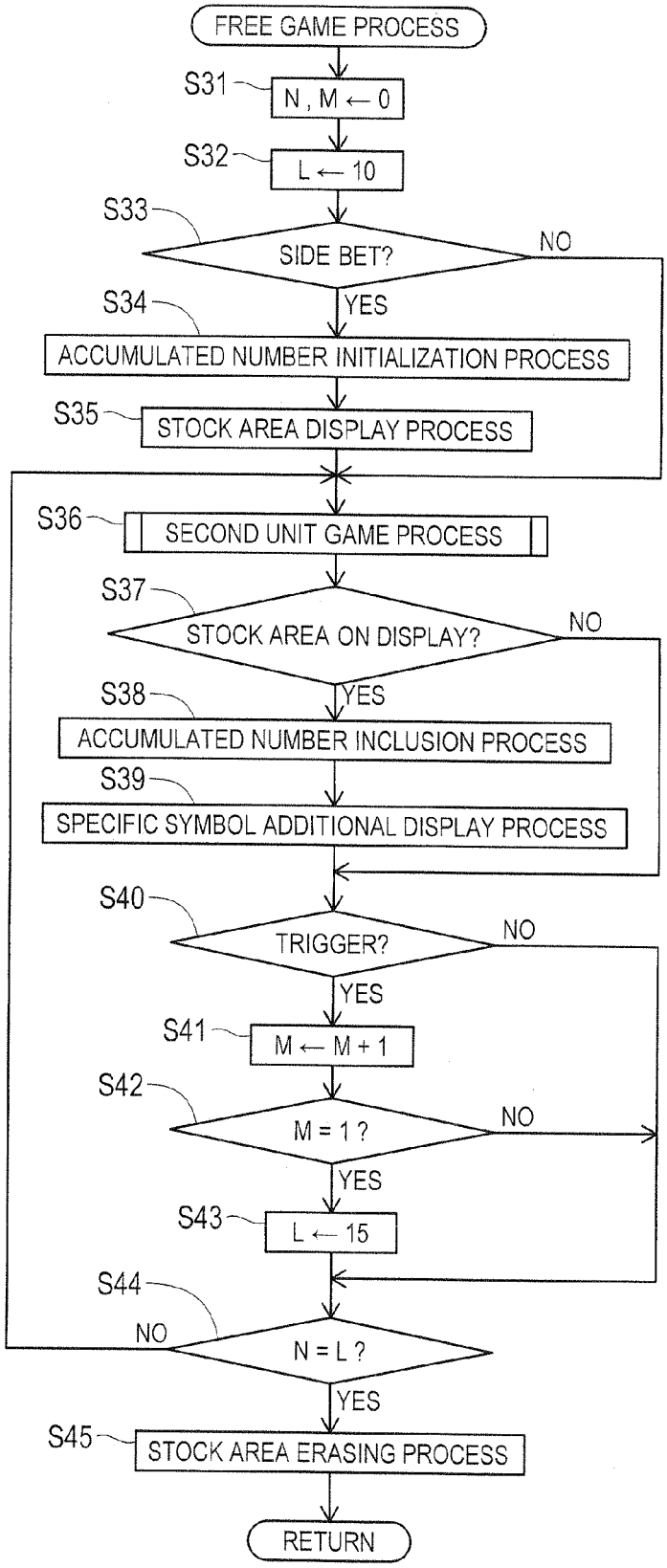
FIG. 14 is a flowchart of a free game process program.

Next, a sub process of the free game process in S15 above will be explained based on the drawings. FIG. 14 is a flowchart of the sub process of the free game process program in the slot machine 1 according to the present embodiment. Incidentally, a program shown in the flowchart of FIG. 14 is stored in the ROM 34 or the RAM 33 of the slot machine 1, and is executed by the main CPU 32.

First, in the free game process of S15 above, as shown in FIG. 14, the main CPU 32 sets "0" to a variable N and a variable M that are stored in the RAM 33 in S31. In S32, the main CPU 32 sets "10" to a variable L which is stored in the RAM 33.

Next, in S33, the main CPU 32 determines whether or not there is a side bet. This determination is made based on a signal which is input to the main CPU 32 depending on pressing the operation buttons 11. At this point, if there is not a side bet (S33: NO), the process proceeds to S36 mentioned below. In contrast, if there is a side bet (S33: YES), the process proceeds to S34.

In S34, the main CPU 32 executes an accumulated number initialization process. In this process, the main CPU 32 initializes an accumulated number which is stored in the RAM 33 by overwriting the accumulated number with "0". Thereafter, the process proceeds to S35.

In S35, the main CPU 32 executes a stock area display process. In this process, the main CPU 32 sends a control signal to the sub control board 72 to display the stock area 201 of the liquid crystal panel 5B. Thereafter, the process proceeds to S36.

Figure 15:
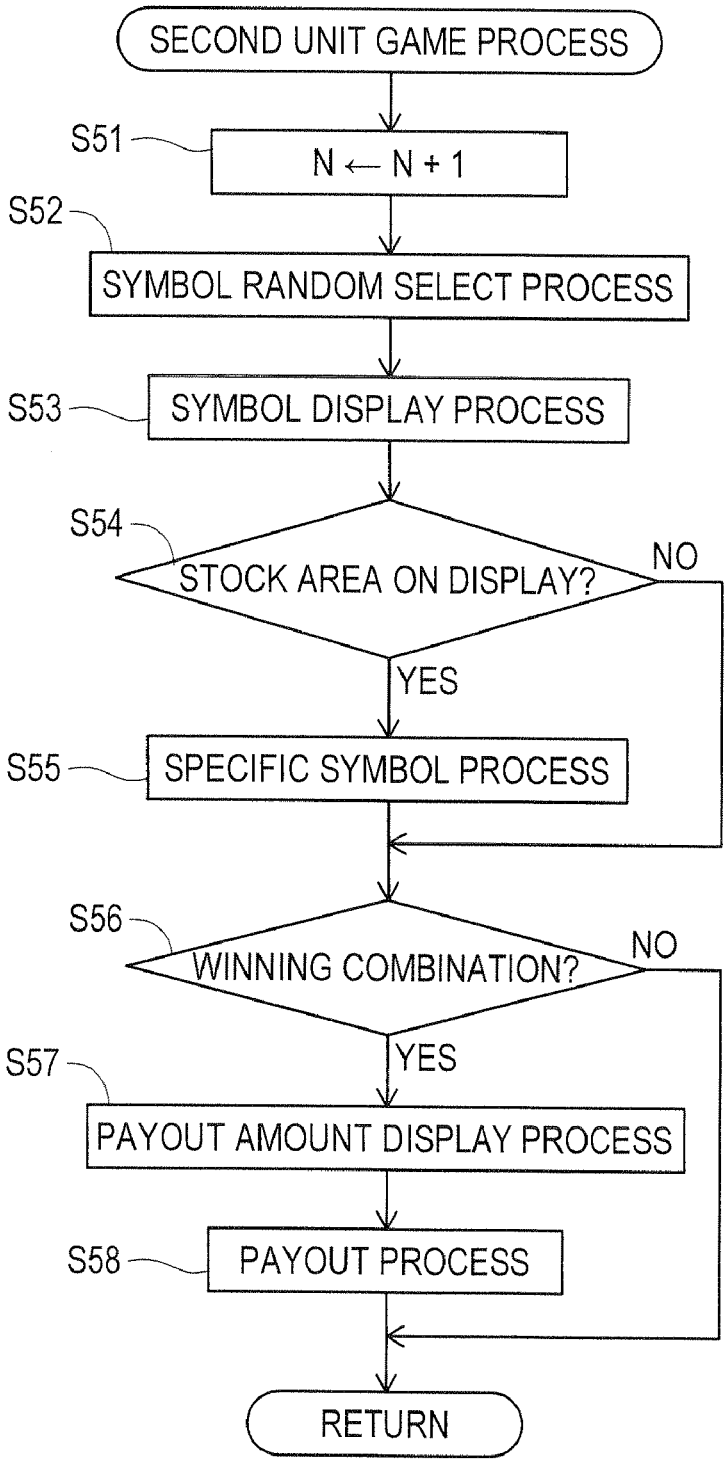
FIG. 15 is a flowchart of the second unit game process program.

In S36, the main CPU 34 executes a second unit game process. So, a sub process of the second unit game process will be explained based on FIG. 15. FIG. 15 is a flowchart of the second unit game process program in the slot machine 1 according to the present embodiment. Incidentally, each program shown in the flowchart of FIG. 15 below is stored in the ROM 34 or the RAM 33 of the slot machine 1, and is executed by the main CPU 32.

In the second unit game process of S39 above, as shown in FIG. 15, the main CPU 32 increments the variable N in S51. Subsequently, the main CPU 32 executes a symbol random select process of S52 and a symbol display process of S53. In this respect, the symbol random select process of S52 is same as the symbol random select process of S21 above. The symbol display process of S53 is same as the symbol display process of S22 above. Therefore, explanation of each process will be omitted.

In S54, the main CPU 32 determines whether or not the liquid crystal panel 5B has displayed the stock area 201. At this point, if the liquid crystal panel 5B has not displayed the stock area 201 (S54: NO), the process proceeds to S56 mentioned below. In contrast, if the liquid crystal panel 5B has displayed the stock area 201 (S54: YES), the process proceeds to S55.

In S55, the main CPU 32 executes a specific symbol process. In this process, the main CPU 32 considers that the symbols of "APPLE" displaying in the stock area 201 are being rearranged in the symbol display frame 111. Specifically, in each process of S56 below and S58 below, when the main CPU 32 counts the number of the symbols of "APPLE" that are being rearranged in the symbol display frame 111, the main CPU 32 obtains the number of the symbols of "APPLE" that are being rearranged in the symbol display frame 111 by adding the accumulated number stored in the RAM 33 to the counted number.

In S56, the main CPU 32 determines whether or not there is a winning combination. This determination is made based on a code number which is overwritten to code number information stored corresponding to each symbol display area of the symbol display frame 111 of the liquid crystal panel 5B in the RAM 33 or the accumulated number stored in the RAM 33. At this point, if there is not a winning combination (S56: NO), the process returns to the free game process of FIG. 14 above. In contrast, if there is a winning combination (S56: YES), the main CPU 32 executes a payout amount display process of S57 and a payout process of S58. In this respect, the payout amount display process of S57 is same as the payout amount display process of S24 above. The payout process of S58 is same as the payout process of S25 above. Therefore, explanation of each process will be omitted.

Thereafter, the process returns to the free game process of FIG. 14 above.

Returning to FIG. 14 above, in S37, the main CPU 32 determines whether or not the liquid crystal panel 5B has displayed the stock area 201. At this point, if the liquid crystal panel 5B has not displayed the stock area 201 (S37: NO), the process proceeds to S40 mentioned below. In contrast, if the liquid crystal panel 5B has displayed the stock area 201 (S37: YES), the process proceeds to S38.

In S38, the main CPU 32 executes an accumulated number inclusion process. In this process, the main CPU 32 counts the number of the symbols of "APPLE" that are being rearranged in the symbol display frame 111 of the liquid crystal panel 5B. This count is made based on a code number which is overwritten to code number information stored corresponding to each symbol display area of the symbol display frame 111 of the liquid crystal panel 5B in the RAM 33. Then, the main CPU 32 includes the counted number in the accumulated number stored in the RAM 33. Thereafter, the process proceeds to S39.

In S39, the main CPU 32 executes a specific symbol additional display process. In this process, by sending a control signal to the sub control board 72, the main CPU 32 moves the symbol of "APPLE" which is being rearranged in the symbol display frame 111 of the liquid crystal panel 5B to the stock area 201, where it is displayed.

However, after five symbols of "APPLE" are displayed in the stock area 201, this operation of moving and displaying is not executed.

In S40, the main CPU 32 determines whether or not a bonus game trigger is realized. This determination is same as that of S14 above. Therefore, explanation of this process will be omitted. At this point, if a bonus game trigger is not realized (S40: NO), the process proceeds to S44 mentioned below. In contrast, if a bonus game trigger is realized (S40: YES), the process proceeds to S41.

In S41, the main CPU 32 increments the variable M. Then, the main CPU 32 determines whether or not the variable M is "1" in S42. At this point, if the variable M is not "1" (S42: NO), the process proceeds to S44 mentioned below. In contrast, if the variable M is "1" (S42: YES), the process proceeds to S43.

In S43, the main CPU 32 sets the variable L to "15". Thereafter, the main CPU 32 determines whether or not the variable N is equal to the variable L in S44. At this point, if the variable N is not equal to the variable L (S44: NO), the process returns to S36 above. In contrast, if the variable N is equal to the variable L (S44: YES), the process proceeds to S45.

Incidentally, in each process of steps from S40 above to S44 above, only when a bonus game trigger is realized for the first time in a free game, the predetermined number of times that a slot game is repeated in the free game is increased from ten to fifteen.

In S45, the main CPU 32 executes a stock area erasing process. In this process, the main CPU 32 erases the stock area 201 from the liquid crystal panel 5B by sending a control signal to the sub control board 72. Thereafter, the process returns to the main game process of FIG. 12 above. With the above, the main control program is executed in the slot machine 1 according to the present embodiment.

7. Others

Incidentally, the present invention is not limited to the above embodiments, but various changes may be made without departing from its scope.

For example, after shifting to a free game, the stock area 201 may be displayed on the liquid crystal panel 5B regardless of whether or not a player performs a side bet operation.

The stock area 201 may be displayed on the liquid crystal panel 5B suddenly in a free game.

The stock area 201 may be displayed on the liquid crystal panel 5B in a slog game. In this case, in the slot game, the amount of a payout which is awarded to a player is computed based on a total number of the symbols of "APPLE" obtained by adding the number of symbols of "APPLE" being displayed in the stock area 201 to the number of symbols of "APPLE" that are being rearranged in the symbol display frame 111 of the liquid crystal panel 5B. The symbol of "APPLE" which is being rearranged in the symbol display frame 111 of the liquid crystal panel 5B is moved to the stock area 201, where it is displayed.

What is claimed is:

1. A slot machine comprising:

a plurality of specific symbols;

an accumulated number whose operand is a number of the specific symbols that have appeared;

a plurality of symbols including the specific symbol;

a symbol group including the symbols;

a display device for displaying some of the symbols in an arranged state and for displaying a stock area during a predetermined period;

a unit game in which a prize is awarded based on a total number of the same symbols which are arranged on the display device to a player; and a processor which is programmed, for progressing the unit game repeatedly with carry-over of the accumulation number;

wherein the processor is programmed to store the accumulation number in a memory between unit games or at the end of a reel spin, and wherein the processor is programmed to execute each of processes from the process of (1) below to the process of (7) below:

(1) selecting some of the symbols at random from the symbol group upon starting the currently unit game;

(2) displaying on the display device the selected symbols in a rearranged state;

(3) awarding a player a prize corresponding to a total number obtained by adding a number of the specific symbols included in the rearranged symbols to the accumulated number;

(4) awarding the player a prize corresponding to a total number of the same symbols included in the rearranged symbols and finishing the current unit game;

(5) including the number of the specific symbols included in the rearranged symbols in the accumulated number upon finishing the current unit game;

(6) executing the processes of (3) above and (5) above only when the stock area is being displayed on the display device; and (7) adding the specific symbol of the operand to the stock area, in executing the process of (5) above.

2. The slot machine of claim 1, further comprising:

an input device with which a player performs a normal bet operation or a side bet operation for the unit game, wherein the processor is programmed to execute each of processes from the process of (8) below to the process of (9) below:

(8) executing the process of (1) above upon finishing a normal bet operation for the current unit game with the input device by the player regardless of whether or not the player performed the normal bet operation together with a side bet operation; and (9) displaying the stock area on the display device upon finishing the current unit game under a condition of satisfying a first predetermined condition in the current game, if the stock area is not displayed on the display device, only when the player performs a side bet operation for the current unit game with the input device.

3. The slot machine of claim 1, wherein the processor is programmed to execute a process of (10) below:

(10) erasing the stock area from the display device upon finishing the current unit game under a condition of satisfying a second predetermined condition in the current game, if the stock area is being displayed on the display device.

4. A slot machine, comprising:

a plurality of specific symbols;

an accumulated number whose operand is a number of the specific symbols that have appeared;

a plurality of symbols including the specific symbol;

a symbol group including the symbols;

a display device for displaying some of the symbols in an arranged state and for displaying a stock area during a predetermined period;

a unit game in which a prize is awarded based on a total number of the same symbols which are arranged on the display device to a player;

a plurality of trigger symbols included in the symbols;

an input device with which a player performs a normal bet operation for the unit game;

a base game which composed of each of the unit games;

a free game in which the unit game is repeated for a predetermined number of times continuously; and a processor which is programmed, for progressing the free game with carry-over of the accumulation number among each of the unit games that composed the free game, wherein the processor is programmed to store the accumulation number in a memory between unit games or at the end of a reel spin, and wherein the processor is programmed to execute each of processes from the process of (1) below to the process of (14) below:

(1) starting the unit game which composed the base game upon finishing a normal bet operation for the unit game which composed the base game with the input device by a player;

(2) selecting some of the symbols from the symbol group at random upon starting the unit game of the process of (1) above;

(3) displaying on the display device the symbols selected at the process of (2) above in a rearranged state;

(4) awarding the player a prize corresponding to a total number of the same symbols included in the symbols rearranged at the process of (3) above and finishing the current unit game in the basic game;

(5) shifting a game mode from the base game to the free game and repeating the unit game which composed the free game for the predetermined number of times continuously, only when the number of the trigger symbols included in the symbols rearranged at the process of (3) above is equal to a predetermined number or more;

(6) displaying the stock area on the display device upon shifting a game mode from the base game to the free game;

(7) selecting some of the symbols from the symbol group at random upon starting the current unit game in the free game;

(8) displaying on the display device the symbols selected in the process of (7) above in a rearranged state;

(9) awarding the player a prize corresponding to a total number which is obtained by adding a number of the specific symbols included in the symbols rearranged at the process of (8) above to the accumulated number;

(10) awarding the player a prize corresponding to a total number of the same symbols included in the symbols rearranged at the process of (8) above and finishing the current unit game in the free game;

(11) upon finishing the current unit game in the free game, including the number of the specific symbols included in the symbols rearranged at the process of above (8) in the accumulated number and adding the specific symbol of the operand to the stock area, where the specific symbol of the operand is displayed upon finishing the current unit game in the free game;

(12) determining whether or not the unit game which composed the free game has been repeated for the predetermined number of times continuously;

(13) starting newly the unit game in the free game and returning to the process of (7) above if it is determined that the unit game which composed the free game has not been repeated for the predetermined number of times continuously; and

(14) erasing the stock area from the display device and finishing the free game and shifting a game mode from the free game to the base game if it is determined that the unit game which composed the free game has been repeated for the predetermined number of times continuously.

5. A slot machine, comprising:

a plurality of specific symbols;

an accumulated number whose operand is a number of the specific symbols that have appeared;

a plurality of symbols including the specific symbol;

a symbol group including the symbols;

a display device for displaying some of the symbols in an arranged state and for displaying a stock area during a predetermined period;

a unit game in which a prize is awarded based on a total number of the same symbols which are arranged on the display device to a player;

a plurality of trigger symbols included in the symbols;

an input device with which a player performs a normal bet operation or a side bet operation for the unit game;

a base game which composed of each of the unit games;

a free game in which the unit game is repeated for a predetermined number of times continuously; and a processor which is programmed, for progressing the free game with carry-over of the accumulation number among each of the unit games that composed the free game, wherein the processor is programmed to store the accumulation number in a memory between unit games or at the end of a reel spin, and wherein the processor is programmed to execute each of processes from the process of (1) below to the process of (14) below:

(1) starting the unit game which composed the base game upon finishing a normal bet operation for the unit game which composed the base game with the input device by a player regardless of whether or not the player performed the normal bet operation together with a side bet operation;

(2) selecting some of the symbols from the symbol group at random upon starting the unit game of the process of (1) above;

(3) displaying on the display device the symbols selected at the process of (2) above in a rearranged state;

(4) awarding the player a prize corresponding to a total number of the same symbols included in the symbols rearranged at the process of (3) above and finishing the current unit game in the basic game;

(5) shifting a game mode from the base game to the free game and repeating the unit game which composed the free game for the predetermined number of times continuously, only when the number of the trigger symbols included in the symbols rearranged at the process of (3) above is equal to a predetermined number or more;

(6) displaying the stock area on the display device upon shifting a game mode from the base game to the free game, if the player performs a side bet operation for the unit game of the process of (1) above by a bet operation which is performed by the player using the input device;

(7) selecting some of the symbols from the symbol group at random upon starting the current unit game in the free game;

(8) displaying on the display device the symbols selected in the process of (7) above in a rearranged state;

(9) awarding the player a prize corresponding to a total number which is obtained by adding a number of the specific symbols included in the symbols rearranged at the process of (8) above to the accumulated number only when the stock area is displayed on the display device;

(10) awarding the player a prize corresponding to a total number of the same symbols included in the symbols rearranged at the process of (8) above and finishing the current unit game in the free game;

(11) upon finishing the current unit game in the free game, only when the stock area is being displayed on the display device, including the number of the specific symbols included in the symbols rearranged at the process of above (8) in the accumulated number and adding the specific symbol of the operand to the stock area;

(12) determining whether or not the unit game which composed the free game has been repeated for the predetermined number of times continuously;

(13) starting newly the unit game in the free game and returning to the process of (7) above if it is determined that the unit game which composed the free game has not been repeated for the predetermined number of times continuously; and

(14) erasing the stock area from the display device and finishing the free game and shifting a game mode from the free game to the base game if it is determined that the unit game which composed the free game has been repeated for the predetermined number of times continuously.

* * * * *